United States Patent [19]

Mikami et al.

[11] 4,375,229

[45] Mar. 1, 1983

[54] METHOD AND APPARATUS OF AUTOMATICALLY POSITIONING WIRE ENDS FOR MULTI-MODE END PROCESSING

[75] Inventors: Hitoshi Mikami, Susono; Toshimasa Saito; Hiroshi Ichikawa, both of Shizuoka, all of Japan

[73] Assignee: Yazaki Corporation, Tokyo, Japan

[21] Appl. No.: 140,017

[22] Filed: Apr. 14, 1980

[30] Foreign Application Priority Data

| | | | |
|---|---|---|---|
| Apr. 28, 1979 | [JP] | Japan | 54-052050 |
| Apr. 28, 1979 | [JP] | Japan | 54-052051 |
| Apr. 28, 1979 | [JP] | Japan | 54-052052 |
| Apr. 28, 1979 | [JP] | Japan | 54-052053 |
| Apr. 28, 1979 | [JP] | Japan | 54-052054 |
| Apr. 28, 1979 | [JP] | Japan | 54-052055 |
| Apr. 28, 1979 | [JP] | Japan | 54-056570[U] |
| Apr. 28, 1979 | [JP] | Japan | 54-056572[U] |

[51] Int. Cl.[3] ..... H01R 43/00

[52] U.S. Cl. ..... 140/102; 29/753

[58] Field of Search ..... 140/102; 29/748, 753; 72/338, 311, 156

[56] References Cited

U.S. PATENT DOCUMENTS

| | | | |
|---|---|---|---|
| 2,810,421 | 10/1957 | Dolney et al. | 72/155 X |
| 2,976,895 | 3/1961 | Durham, Jr. | 140/102 |
| 3,100,512 | 8/1963 | Sage | 140/102 |
| 3,369,434 | 2/1968 | Schwalm | 83/17 |
| 3,686,752 | 8/1972 | Hammond | 140/102 X |
| 4,244,101 | 1/1981 | Talley | 29/753 |

FOREIGN PATENT DOCUMENTS 51-136186 11/1976 Japan .

*Primary Examiner*—Kenneth J. Ramsey

*Attorney, Agent, or Firm*—Brumbaugh, Graves, Donohue & Raymond

[57] ABSTRACT

A new method of automatically positioning opposite ends of a wire is provided. The leading end portion of the wire is clamped to place the wire in a hair-pin configuration and gripped and cut off with the opposite ends aligned correctly. Then, the cut-off wire is moved laterally in a stepwise manner. Between two successive movements the wire ends can be subjected to insulative cover removing process or terminal attaching processes selectively. There is also provided an apparatus for putting the above method into practice. The apparatus comprises means for repeatedly paying out wire from a wire source, a wire reversing body which clamps a wire end portion and reversing the wire end by 180 degrees, means for gripping the wire, and a cutter for cutting off, from the wire, a wire in a hair-pin configuration. The gripping means is moved laterally. Along its movement, a plurality of wire end processing units are aligned.

38 Claims, 16 Drawing Figures

FIG. 10-A
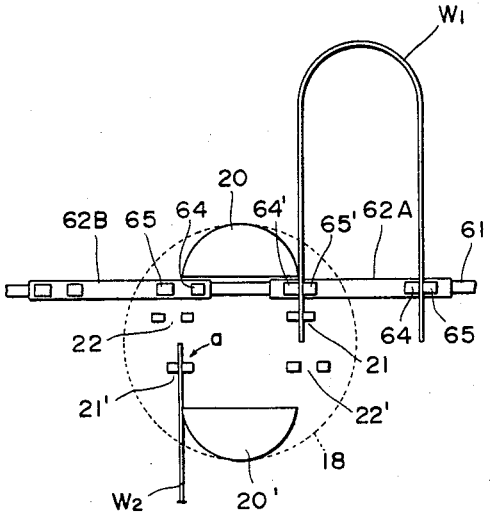
FIG. 10-B
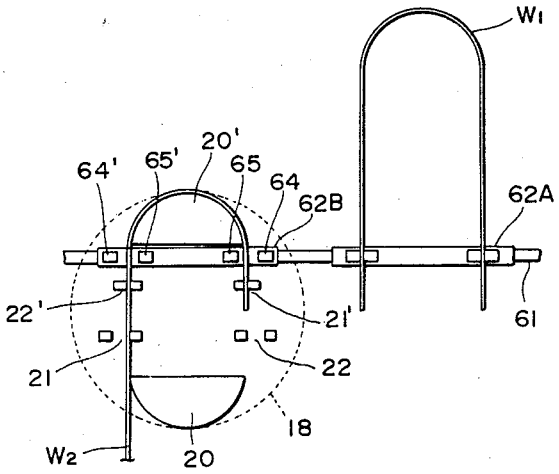

FIG. 10-C
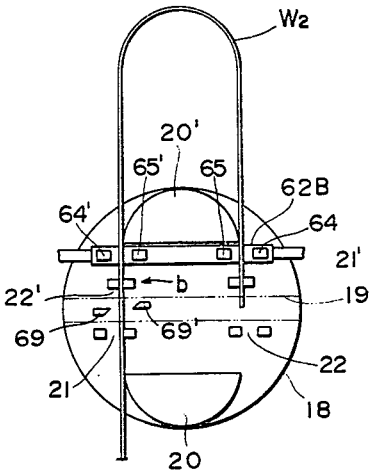
FIG. 10-D
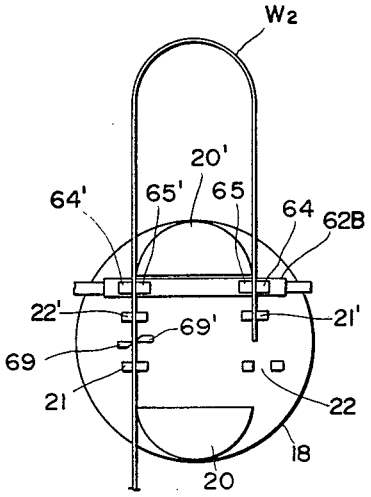
FIG. 10-E
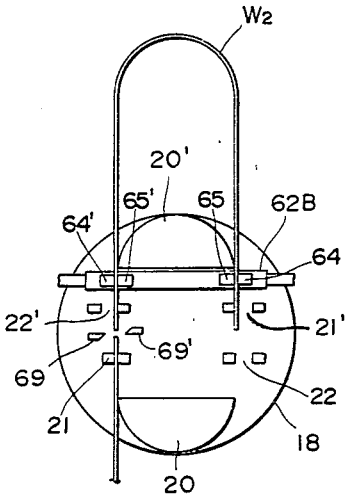
FIG. 10-F
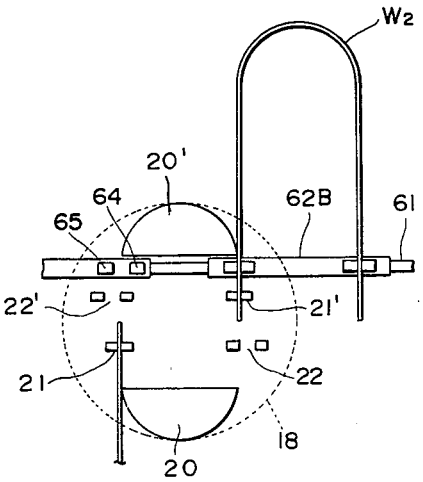

METHOD AND APPARATUS OF AUTOMATICALLY POSITIONING WIRE ENDS FOR MULTI-MODE END PROCESSING

BACKGROUND OF THE INVENTION

The present invention relates to an improvement in a wire processing method to prepare wires necessary for electric wiring by cutting off a predetermined length of a wire fed from a wire paying-out device, conveying the cut length of wire in a direction perpendicular to the axial direction of the paid-out wire and subjecting the wire end portions to various kinds of processing which include stripping of the wire ends and attachment of connectors.

A current trend in the art of wire harness production is rather to a small amount, many-kind production system than to a simple system based on quantity alone. In this connection, there is an increasing demand for a method and apparatus which, using a single wire processing device, performs, for example, crimping and pressing of different kinds of electric connectors on various standards and lengths of wires.

Such a demand may be met by a recently proposed automatic wire processing system (Japanese patent application Publication No. 51-136186) which includes a wire feeder for drawing, measuring and cutting a wire, pallet facing the wire feeder for reversing and gripping a cut length of wire in a hair-pin configuration and means for moving the pallet in a direction perpendicular to the axis of the wire. However, such a proposal still fails to process end portions of the wire in the pallet unless the wire is transferred completely with the pallet to the next station. The pallet holding the cut wire cannot advance to a farther station unless stripping of the wire ends, pressing of connectors on the uncovered wire ends and like procedures are completed. This can bring about a considerable production delay. Furthermore, it is inevitable that the wire feeder and pallet conveying means are complex in construction.

An object of the present invention is to provide a wire processing method which promotes high-speed and specific operations on wires such as measurement and cut-off and achieve many kind, small amount production by shortening a programming time for a lot change while eliminating mechanical adjustment caused by the programming. In order to achieve this objective, a method according to the invention includes the steps of causing wire clamp pawls on a reversing device to grip an end portion of a wire paid out from a wire feeder, reversing the wire by the reversing device in a direction opposite to the direction of wire feed, and allowing the wire feeder to supply a desired length of wire on a side of the wire opposite to one gripped by the clamp pawls.

BRIEF DESCRIPTION OF THE DRAWINGS

FIGS. 10A–10F show an operating cycle including the paying-out motion, cut-off, and transfer of a wire.

DETAILED DESCRIPTION OF THE PREFERRED EMBODIMENT

The present invention will hereinafter be described with reference to the accompanying drawings.

Figure 1:
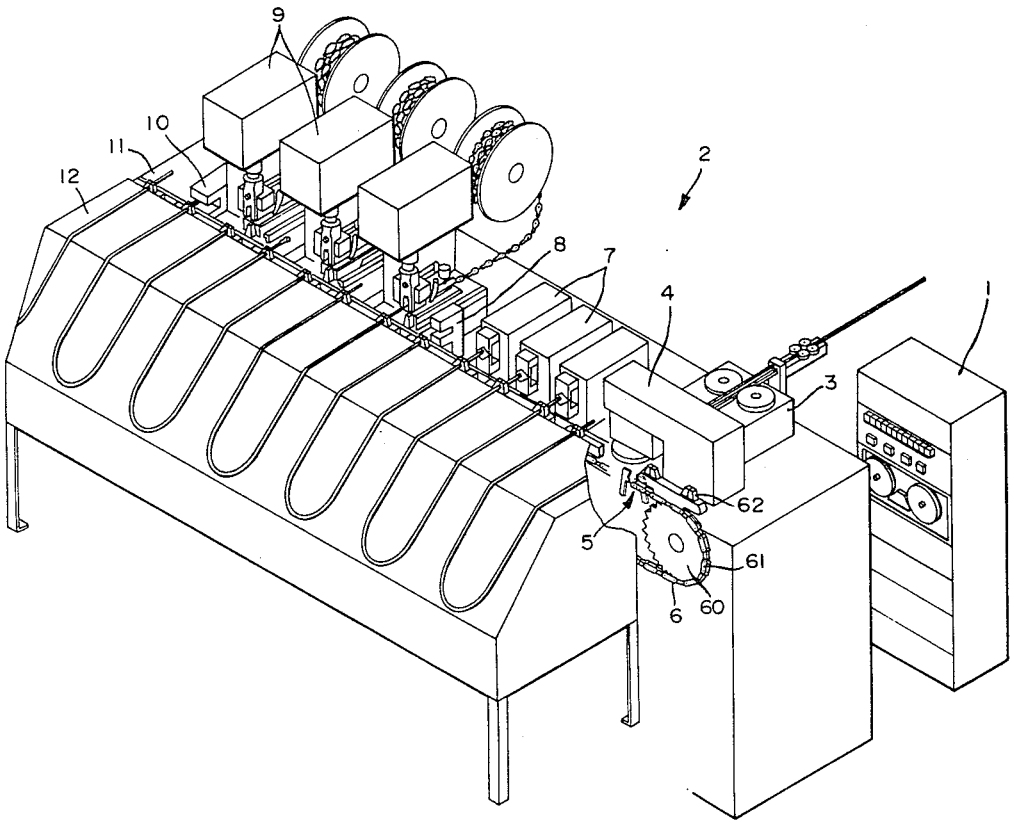
FIG. 1 is a general perspective view of a wire processing system in accordance with the present invention.

A wire processing system for practicing a method of the invention is illustrated in perspective in FIG. 1.

The system includes an automatic control apparatus 1 and a wire processing apparatus 2 made up of various assemblies. Each assembly of the apparatus 2 is operated by an output signal of the control 1 which is based on information carried on a magnetic tape or like storage means of the control.

The apparatus 2 generally includes a wire feed device 3 adapted to pay out a wire from a reel by a predetermined distance. A wire W supplied by the device 3 has its end portion clamped and reversed in a hair-pin configuration by a reversing device 4 which is rotatable along the paid-out direction of wire. A cutting device 5 cuts off a predetermined length of the wire fed in relation with the action of the devices 4 and 3. A conveyor device 6 functions to transfer the wire cut off by the cutting device 5 to any of various devices for processing the ends of the wire. A stripping device 7 removes the insulating cover from each end portion of the wire brought thereto by the conveyor. Whether the uncovered condition of the wire is acceptable is determined by a sensor 8. The wire moved past the sensor 8 reaches devices 9 each of which is adapted to press an electric connector member onto a naked conductor portion of the wire. The clamped condition of the connector on the wire is judged by a sensor 10. The apparatus 2 further includes a platform 11 on which the respective devices are mounted and a table 12 for supporting the wires carried by the conveyor 6.

Of the various devices, those constituting major parts of the wire processing apparatus will be described in more detail.

Figure 2:
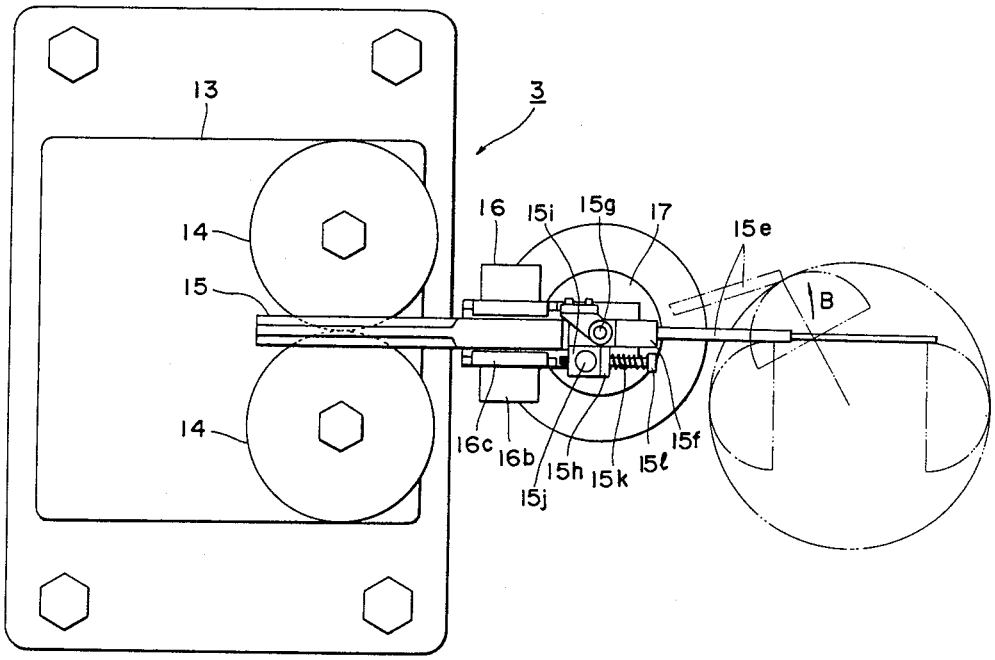
FIG. 2 shows in plan roller plates, rocking nozzle assembly and a wire reversing body.
Figure 3:
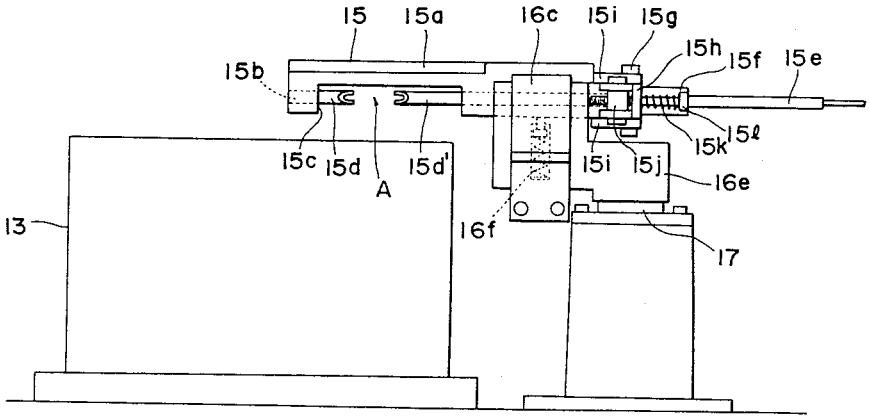
FIG. 3 is a side elevation of FIG. 2.

The wire feeder 3 is shown in plan in FIG. 2 and in side elevation in FIG. 3. Referring to these drawings, a pair of roller plates 14 for paying out the wire W by a predetermined distance are rotatably mounted on a support 13. A link and lever mechanism (not shown) drives roller plates 14 toward and away from each other. When juxtaposed, the roller plates will nip the wire W therebetween to advance it in the preselected direction; in the event the reversing device 4 rotates, they will move away from each other to permit a free movement of the wire.

Figure 5:
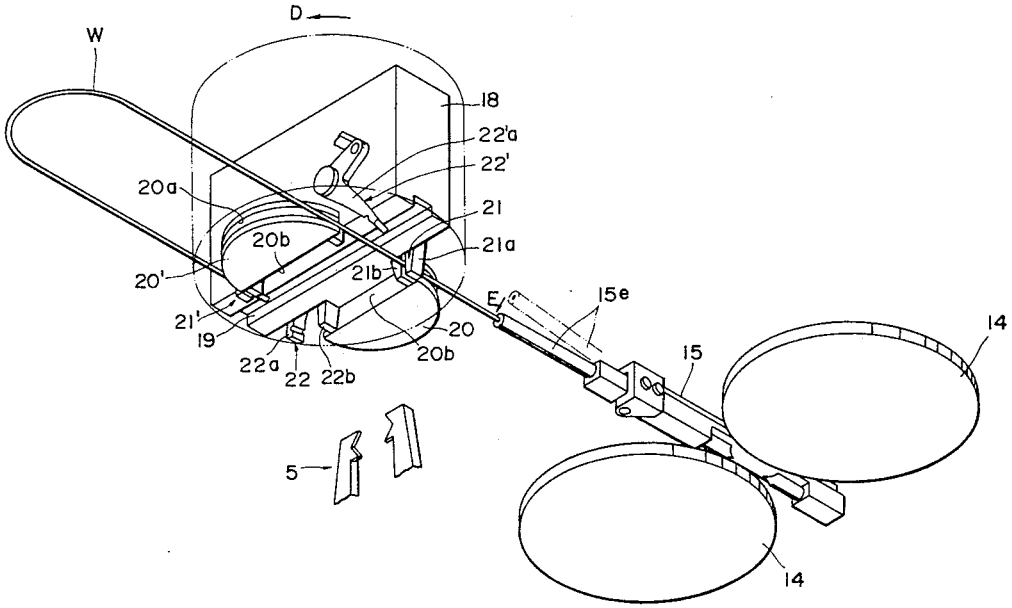
FIG. 5 schematically indicates in perspective the correlation among the roller plates, the rocking nozzle assembly, the reversing body and a cutting device.

The wire paid out by the roller plates 14 from a reel advances through a rocking nozzle assembly 15 to the reversing device 4. The nozzle assembly 15 is detachably mounted to a nozzle clamp 16 which is in turn mounted to the top of a plunger 17, which reciprocates vertically in interlocked relation with a body 18 of the reversing device 4 (FIG. 5). The rocking nozzle assembly 15 includes a nozzle support block **15*a* having a recess 15***c* and aligned axial bores 15*b* to guide the wire. Fixed to the block 15*a* within the recesses 15*c* are two pipes 15*d* and 15*d'* which communicate with the axial bores 15*b* and oppose each other at a suitable spacing A. Said spacing A is positioned at the intermediate between the roller plates 14. A nozzle fixing member 15*f* carrying a nozzle piece 15*e* therewith is pivotted to the front end of the block 15*a* through a pin 15*g*. A spring retaining plate 15*h* extends sideways from the rear end of the member 15*f*. Upper and lower flat pieces 15*i* protrude from one side wall of the block 15*a* to confront the spring retainer 15*h* while a pin 15*j* is rotatably mounted at opposite ends to the flat pieces 15*i*. A headed adjusting screw 15*l* is passed through a perforation of the spring retainer 15*h* into threaded engagement with the pin 15*j*. A coiled compression spring 15*k* is wound around the screw 15*l* with its one end seated on the head of the screw and the other on the spring retainer 15*h*.

The nozzle piece 15*e* when subjected to an external force will swing as indicated by an arrow B to the phantom line position but, when the external force fades, will regain the original position under the action of the coil spring 15*k*. It will be noted that the resilient force of the spring 15*k* is controllable by turning the adjusting screw 15*l* as desired.

Figure 4:
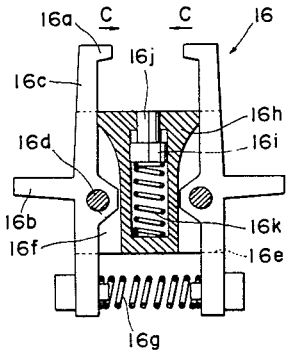
FIG. 4 depicts the details of a nozzle clamp.

FIG. 4 illustrates the details of the nozzle clamp 16 for fixing the rocking nozzle assembly in place. As shown, the nozzle clamp comprises a pair of confronting clamping plates 16*c* each having an inward lug 16*a* at the upper end and an outward lug 16*b* at an intermediate portion. The intermediate portions of the clamping plates 16*c* are pivotally mounted by pins 16*d* to upright support plates 16*f* secured to opposite sides of a clamp body 16*e* such that the clamping plates pivot in a plane lateral to the wire axis. A coiled compression spring 16*g* abuts against inner lower portions of the side plates 16*c* so that the upper ends of the members 16*c* are constantly biased towards each other as indicated by arrows C. Fixedly positioned between the members 16*c* is a spring holder 16*h* which has a bore and an opening extending through the upper wall in communication with the bore. A nozzle presser pin 16*j* having a head or flange 16*i* is slidably engaged in the opening of the spring holder 16*h*. A spring 16*k* rests at one end on the bottom of the bore of the fixed holder 16*h* and at the other end on the flange 16*i* of the movable pin 16*j*. The top of the pin 16*j* is therefore constantly biased by the spring 16*k* to protrude upward from the opening of the holder.

When the nozzle support block 15*a* of the nozzle assembly 15 is brought into the space defined substantially by the top of the spring holder 16*h* and opposing plates 16*c*, the plates 16*c* biased by the spring 16*g* firmly hold the block therebetween while the vertical movement of the block is regulated by the inward lugs 16*a* of the members 16*c* and spring-biased pin 16*j*. The nozzle assembly 15 is thus positively fixed in a predetermined operating position. To demount the nozzle assembly 15, the outward lugs 16*b* of the plates 16*c* will be pushed down by fingers to move the members 16*c* away from each other opposite to the directions C. Then the pin 16*j* will push the block 15*a* upward instantly promoting easy removal of the nozzle assembly.

FIG. 5 illustrates in schematic perspective the positional relationship among the roller plates 14, nozzle assembly 15, elongated wire reversing body 18 of the reversing device 4 and cutting device 5.

The wire reversing body 18 has a groove 19 extending along its center line across its bottom and permitting the entry of cutting edges of the device 5 therein. Two semicircular plate members 20 and 20' are rigid on the bottom of the body 18 on opposite sides of the recess 19. Each of these members 20 and 20' is formed with a wire guide groove 20*a* along its semi-circular portion.

The body 18 also carries therewith two sets of wire clamp pawls 21 and 21' and two pairs of wire guide pawls 22 and 22' interposed between the recess 19 and opposite semicircular plate members 20 and 20' in symmetrical positions with respect to the center of rotation of the body 18. More specifically, the diametrical end 20*b* of each member 20 or 20' is confronted by one clamp pawl set 21 or 21' and one guide pawl pair 22 or 22' near opposite sides thereof. The clamp pawl pair 21 (21') comprises a movable pawl 21*a* and a stationary pawl 21*b* and likewise, the guide pawl set 22 (22') includes a movable pawl 22*a* and a stationary pawl 22*b*.

The clamp pawl pair 21' first nips the leading end of the wire W fed to the reversing device by the roller plates 14 and nozzle assembly 15. Then the body 18 rotates 180° as indicated by an arrow D and, thereafter, the feed rollers 14 pay out wire W by a predetermined distance. Consequently, the wire W is brought into a U-shape through the guide pawl pair 22'. This arrangement is depicted in FIG. 5.

During the 180° rotation of the reversing body 18, the nozzle piece 15*e* of the nozzle assembly follows it in engagement with the circumference of the semi-circular plate member 20' as shown by a phantom line in FIG. 5.

Constantly biased by the spring 15*k* in the E direction, the nozzle piece 15*e* prevents the wire W from being slackened by the rotation of the body 18. Since the nozzle piece 15*e* swings in the course of rotation of the body 18, a tension is imparted to the wire W substantially axially of the nozzle piece 15*e*. This avoids friction and damage to the wire attributable to bending and hooking at the front end of the nozzle piece, thereby promoting smooth feed of the wire.

Figure 6:
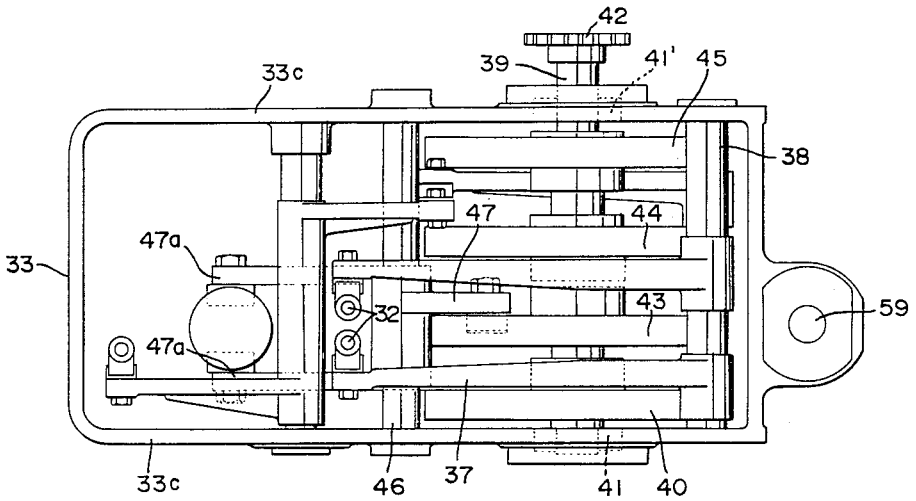
FIG. 6 is a plan view of a reversing device with the top of a cam case removed.
Figure 7:
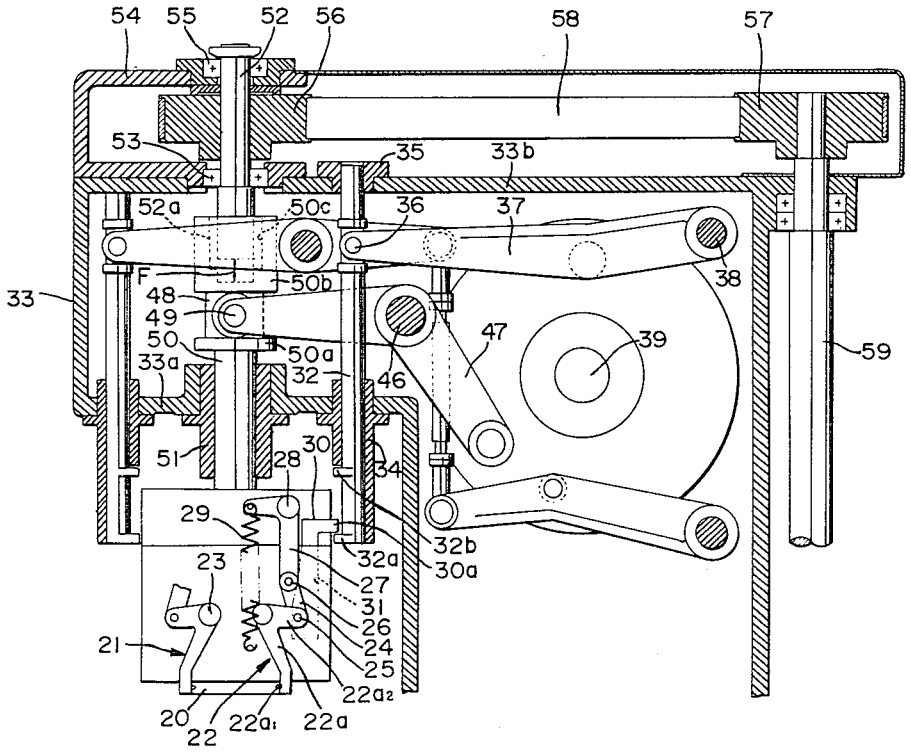
FIG. 7 is a partly sectional side elevation of the reversing device.

The construction of the reversing device 4 will be described, with reference to FIGS. 6 and 7.

Threaded pins 23 pivotally mount the movable pawl 22*a* of the guide pawl pair 22 and movable paw 21*a* of the clmap pawl pair 21 respectively to opposite sides (right and left in FIG. 7) on the front end of the body 18.

The movable pawl 22*a* has a guide groove $22a_1$ on its inner lower surface and and an arm $22a_2$ extending from the upper end.

The arm $22a_2$ connects through a pin 25 to one end of an I-shaped link 24 the other end of which is connected by a pin 26 with the lower end of an L-shaped link 27. A threaded pin 28 pivotally connects this L-shaped link 27 with the reversing body 18. A tension spring 29 has its opposite ends anchored to the other end of the link 27 and a lower portion of the body 18 so that the movable pawl 22*a* usually remains in a closed position.

Opening and closing of the movable pawl 22*a* is caused by vertical reciprocation of an actuating lever 30. The lever 30 has an angled lug 30*a* at the upper end and, on its inner end face, a curved cam portion (not shown) slidably engaged with the pin 26. The lever 30 with such a configuration is slidably received in a slot 31 formed within the body 18. When the actuating lever 30 rises in engagement with a drive shaft 32, the pin 26 is cammed inwardly about the threaded pin 28 by the curved cam portion of the lever 30 to in turn move the associated pawl 22*a* to an open position. Lowering the drive shaft 32 will return the pawl 22*a* to the usual closed position by the action of the tension spring 29.

The drive shaft 32 is formed with levering lugs 32*a* and 32*b* in a lower inner portion thereof which are engagable with the lug 30*a* of the actuating lever 30. Part of the drive shaft above the lug 32*b* extends through a tubular bearing 34 fixed to a front lower wall 33*a* of a cam case 33. The uppermost end of the drive shaft 32 is movably received in a bearing 35 which is secured to an upper wall 33*b* of the cam case 33. A pin 36 connects an upper portion of the drive shaft 32 to one end of a cam arm 37 which has its other end rotatably supported by a shaft 38. An intermediate portion of the cam arm 37 is engaged in a track (not shown) formed on one axial end of a cam disc 40 rigidly mounted to a cam shaft 39.

The cam shaft 39 is supported at opposite ends by bearings 41 and 41' mounted in opposing side walls 33*c* of the cam case 33. A sprocket 42 is securely mounted on one end of the cam shaft 39. Farther cam discs 43, 44 and 45 are consecutively and rigidly mounted on the shaft 39.

The cam disc 43 is adapted to regulate the vertical reciprocation of the reversing body 18 whereas the cam discs 44 and 45 serve to regulate the opening and closing of the clamp pawl pair 21' (not shown) disposed to the rear of the guide pawl pair 22 (FIG. 7) and the clamp pawl pair 21 (FIG. 7), respectively. These pawl pairs 21' and 21 are opened and closed by mechanisms which are common to the mechanism for the guide pawl pair 22 and, therefore, will not be described.

A bifurcated cam arm 47 is rotatably mounted at its intermediate portion on a shaft 46. One end of the cam arm 47 engages in a track (not shown) formed on one axial end of the cam disc 43 while arm 47*a* at the bifurcated end are connected by a pin 49 to a cylindrical retainer 48. This retainer 48 is mounted to an upper portion of shaft 50 which raises and lowers the reversing body 18.

The shaft 50 extends through a tubular bearing 51 secured to a central area of the bottom wall 33*a* of the cam case 33. A flange 50*a* and a bored cylindrical member 50*b* are rigid on an upper portion of the shaft 50 at a spacing from each other and, in this spacing, the retainer 48 is mounted on the shaft 50 to be incapable of vertical movement. The cylinder 50*b* has axial grooves 50*c* on the wall of the bore which receive axial projections 52*a* provided to lower part of a rotatable shaft 52. The bottom of the shaft 52 thus nested in the bore of the cylinder 50*b* is spaced a suitable distance F from the bottom of the bore. With this arrangement, the shaft 50 can reciprocate vertically (over a distance corresponding to the spacing F) but can not rotate relative to the rotary shaft 52.

The shaft 52 extends through a bearing 53 rigidly supported by the upper wall 33*b* of the cam case 33 and has its upper end rotatably mounted in a bearing 55 on a cam case cover 54. Part of the shaft 52 contained in the cover 54 carries a pulley 56 rigidly therewith. A timing belt 58 joins this pulley 56 to a drive pulley 57 mounted on a drive shaft 59 in a rear portion of the cover 54. The drive shaft 59 is capable of 180° stepped motions in one direction provided by a limited rotation motor (not shown).

The shaft 52 connected with the shaft 59 by the pulleys 56 and 57 and belt 58 causes the reversing body 18 into rotation while the shaft 50 connected with the cam disc 43 drives the body 18 into vertical reciprocation.

The cam disc 40 and 43–45 rigid on the cam shaft 39 are formed with tracks thereon in different phases so that, for each 180° rotation of the shaft 39, the pawl pairs 22, 21 and 21' and reversing body 18 are operated individually.

Figure 8:
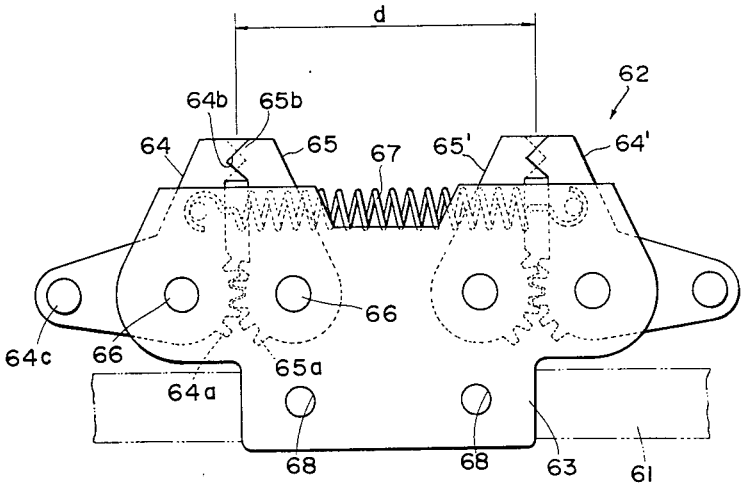
FIG. 8 illustrates a wire gripper in side elevation.
Figure 9:
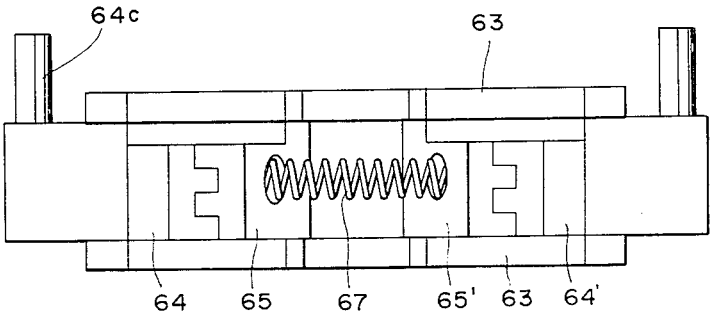
FIG. 9 is a plan view of the wire gripper.

The conveyor 6 is discussed with reference to FIGS. 8 and 9 and FIG. 1.

The conveyor 6 includes a pair of sprockets 60 located in laterally opposite positions on the front end of the mount 11 (only the sprocket is visible in FIG. 1). An endless chain 61 is passed over the sprockets 60 and driven counterclockwise as seen from the front of the mount 11. The chain 61 carries a series of grippers 62 at a common spacing therewith.

Each gripper 62 comprises a pair of opposing support plates 63 and first and second pairs of pawl member 64, 65 and 64', 65'. Outer pawls 64 and 64' and inner pawls 65 and 65' in the individual pairs are commonly interposed between and pivotted by pins 66 to the support plates 63.

Base portions of the cooperating pawls 64 and 65 (64' and 65') have arcuate contours and are partly toothed as at 64*a* and 65*a* to mesh with each other. As seen in FIG. 8, the upper ends of the pawls 64 and 65 are formed with interengaging recesses 64*b* and inwardly extending projections 65*b* so as to ensure a firm grip on the wire when the pawls are closed. A tension spring 67 is anchored at opposite ends to the outer pawls 64 and 64' thereby maintaining the two pawl pairs usually in their closed positions. Pins 64*c* protrude from one side of the base portions of the pawls 64 and 64'.

When the pin 64*c* on the pawl 64 is passed downward, the pawl 64 moves outwardly about the pin 66 and simultaneously causes its associated pawl 65 to move outwardly through the intermeshed teeth 64*a* and 65*a*. The pawls 64 and 65 and thus brought to open positions. The other pawl pair 64', 65' will be operated in the same way as the pawl pair 64, 65.

The distance d between the center of the pawls 64 and 65 and that of the pawls 64' and 65' is equal to the spacing between the clamp pawls 21 and neighboring guide pawls 22 on the reversing body 18. The multiple grippers 62 are secured to the chain 61 through apertures 58 in the side walls 63 and such that immediately adjacent pawls on neighboring grippers are also spaced d. All the neighboring pawls on the grippers are thus located at a common pitch along the chain 61.

Now, reference will be made to FIGS. 10A–10F for describing general procedures for the supply of the wire, cut-off of the wire and conveyance of the cut length of the wire.

(1) FIG. 10A indicates the wire processing apparatus at the start of an operating cycle. The reversing body 18 is in the raised position (shown by a phantom line) and so is the nozzle assembly 15. Neighboring grippers 62A, 62B on the chain 61 have been brought to the illustrated positions.

The clamp pawl pair 21' on the body 18 has nipped the leading end portion of a wire $W_2$ at position a while the gripper 62A has caught both ends of wire $W_1$ in a hair-pin configuration. As seen in the drawing, the left pawls 64' and 65' on the gripper 62A face the underside of the body 18 and the right pawls 64 and 65 on the gripper 62A are positioned outside the body 18. The right pawls 64 and 65 on the next gripper 62B have been opened and located beneath the body 18.

The guide pawl pairs 22 and 22′ on the reversing body 18 are open and the clamp pawl pair 21 is closed.

(2) As the body 18 moves 180° clockwise, the wire $W_2$ is turned around and, simultaneously with or after this turn of the wire, the chain 61 is driven one pitch to the right. This condition is shown in FIG. 10B.

Mores specifically the 180° rotation of the body 18 reverses the wire $W_2$ along the arcuate periphery of the winding member 20′ until the leading end of the wire faces the wire feed station. In the meantime, the roller plates 14 are kept away from each other by a link and lever mechanism to permit a free travel of the wire $W_2$. The movement of the chain 61 brings the right pawl pair 64, 65 and left pawl pair 64′, 65′ on the gripper 62B to between the clamp pawl 21′ and guide pawl 22′ and the winding member 20′ each in the wide open position.

(3) Then the reversing body 18 is lowered (indicated by a solid line in FIG. 10-C) accompanied by synchronized lowering of the nozzle assembly 15. The guide pawls 22′ in position b are closed thereafter and the feed foller plates 14 pay out the wire $W_2$ by a predetermined distance.

Since the reversing body 18 has already fed a determined length of the wire $W_2$ through its 180° rotation, an electric signal actuating the roller plates 14 to supply the additional length by measurement represents the difference between a predetermined total length and the length fed by the body 18.

Cutting edges 69 and 69′ of the cutting device 5 face the diametrical recess 19 on the now lowered reversing body 18 and confront the wire $W_2$ from opposite sides.

(4) After the feed of the measured length of wire $W_2$, the cooperating sets of pawls on the gripper 62B and clamp pawls 21 on the body 18 are closed to grip the wire $W_2$. Then the cutting edges 69 and 69′ move toward each other to cut off the wire $W_2$. This situation is illustrated in FIG. 10D.

(5) Subsequently, the cutting edges 69 and 69′ cut off the wire $W_2$ and the clamp pawls 21′ and guide pawls 22′ are opened as viewed in FIG. 10E. Under this condition, both ends of the cut wire $W_2$ are gripped solely by the pawls on the gripper 62B.

(6) The reversing body 18 again rises and the chain 61 moves another pitch to the right as indicated in FIG. 10F while the clamp and guide pawls on the body 18, gripper 62B and the like are actuated individually into the initial condition of the cycle shown in FIG. 10A.

One cycle for the supply, measurement and cut-off of a wire is completed in this way by the sequential steps (1)–(6), that is, by a single reversal by the body 18.

The chain 61 on the other hand is indexed twice pitch by pitch during the course of one operating cycle of the apparatus. Since all of the pawl pairs 64, 65 and 64′, 65′ on the grippers 62 are arranged on the chain at a common pitch, they transfer opposite ends of respective wires successively to a terminal processing unit within one such operating cycle. In other words, a single terminal processing unit suffices to deal with opposite ends of successive wires.

Characteristically, however, a wire processing method according to the invention promotes "$_{n+1}H_2$" kinds of combined processing of wire ends (inclusive of non-processed wires) if "n" wire end processing units are installed in the apparatus. This is attainable by selective actuation of the multiple units in accordance with the desired sort of treatment.

Figure 11:
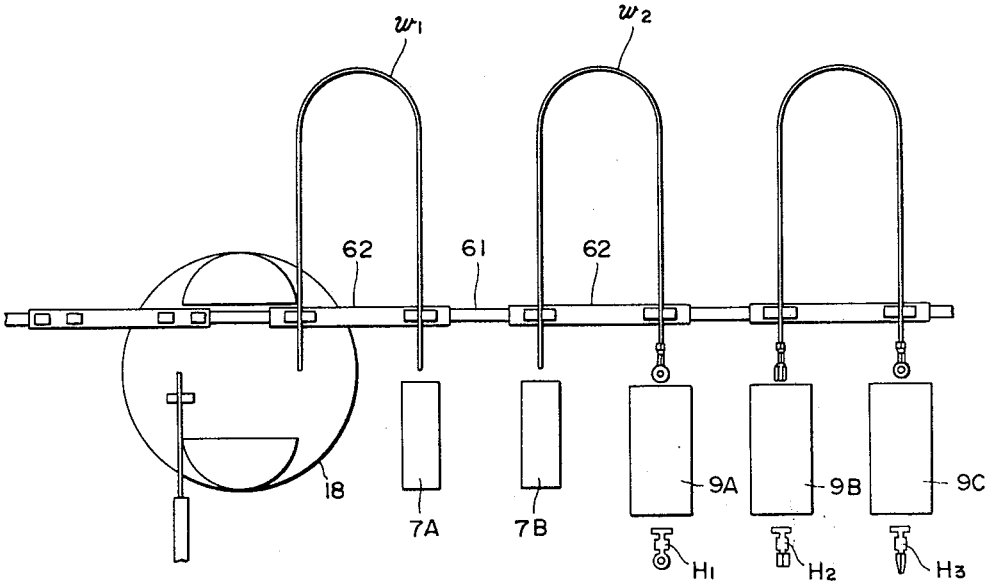
FIG. 11 is explanatory of a step of processing end portions of wires.

Referring to FIG. 11, there are shown two wire stripping units 7A and 7B and three connector pressing units 9A, 9B and 9C arranged in succession with the stripping unit 7A next to the reversing body 18.

The stripping units 7A and 7B are designed to uncover wires to different lengths and/or different depths. Opposite ends of a wire $W_1$ can be processed by any one of these stripping units.

A conventional stripping device needs to have the uncovering lengths adjusted for each one of intended lots and whether this adjustment is adequte affects the quality of the products. Such adjustment on wire stripping becomes unnecessary if multiple stripping units are installed each with a preadjusted peeling length; the need for programming for lot changes is eliminated merely by selectively operating the stripping units 7A and 7B by an automatic control. The multiple stripping units require no mechanical adjustment in the event of lot replacement, yielding products of a constant quality regardless of the lot.

The connector pressing units 9A, 9B and 9C are adapted to attach different shapes and standards of electrical connectors $H_1$, $H_2$ and $H_3$ to wire ends. These units 9A–9C, as the stripping units 7A and 7B, can accommodate changes of lot without mechanical adjustment and the like.

Where the pressing units 9A–9C attach the connectors $H_1$–$H_3$ to opposite ends of a wire $W_2$, the wire ends can be processed in 10 unique combinations which are 0-0 meaning attachment of no connectors, O-$H_1$, O-$H_2$ and O-$H_3$ each meaning attachment of a connector to one wire end, $H_1$-$H_1$, $H_1$-$H_2$ and $H_1$-$H_3$ each meaning attachment of connectors to both wire ends etc. Considering the U shape of the wire $W_2$, other combinations such as $H_2$-$H_1$ inversive to $H_1$-$H_2$ are contemplatable and, thus, the total number of possible combinations is 16.

In summary, a wire processing method according to the invention comprises the steps of causing clamp pawls on a reversing device to grip an end portion of a wire fed by a wire feeder, turning the wire round by the reversing device in a direction opposite to the wire feed direction, paying out, by a desired distance, the wire on the side opposite to one gripped by the clamp pawls and cutting the wire. It will therefore be appreciated that a method of the invention promotes high-speed and rational measurement, cut-off and other steps on wires. Moreover, such a method facilitates production on many-kinds-and-small-amounts basis because it needs no programming time or adjustment for the replacement of lots.

What is claimed is:

1. A method of automatically positioning opposite ends of a wire cut off from a wire source for multi-mode wire-end processings, which comprises the steps of (a) clamping a leading end portion of a wire extending in a predetermined direction and having a leading end thereof resting at a predetermined position wherein said wire is clamped at a distance spaced from said leading end;

(b) pulling the clamped end portion substantially in a semi-circle with a predetermined radius while turning the same clamped end portion by 180 degrees about a fixed center such that said leading end reaches a position symmetrical to the predetermined position relative to the center of said semicircle and the wire is placed in a hair-pin configuration;

(c) paying out said wire by a predetermined distance to follows the pulling movement;

(d) gripping the wire at two intermediate portions near to and spaced from the leading end and the predetermined position;

(e) cutting the wire at said predetermined position to form a trailing end of a cut-off wire; and (f) releasing said clamping of the wire.

2. A method of automatically positioning opposite ends of each of wires successively cut off from a wire source for multi-mode wire-end processing, which comprises the steps of (a) clamping a leading end portion of a wire extending in a predetermined direction and having a leading end thereof resting at a predetermined position;

(b) pulling the clamped end portion substantially in a semi-circle with a predetermined radius while turning the same clamped end portion by 180 degrees about a fixed center such that said leading end reaches a position symmetrical to the predetermined position relative to the center of said semi-circle and the wire is placed in a hair-pin configuration;

(c) paying out said wire by a predetermined distance to follow the pulling movement;

(d) gripping the wire at two intermediate portions near the leading end and the predetermined position;

(e) cutting the wire at said predetermined position to form a trailing end of a cut-off wire;

(f) releasing said clamping of the wire; and (g) moving the two gripped portions of the cut-off wire perpendicularly to the predetermined direction in a step-wise manner by the distance between the leading end and the trailing end of the wire placed in the hair-pin configuration.

3. A method according to claim 2, wherein said steps (a) to (g) are repeated.

4. A method according to claim 3, wherein said moving step is performed by one pitch simultaneously with the pulling step and by another pitch after the wire releasing step in each repetition of the steps (a) to (g).

5. A method according to claim 4, wherein the leading end and the trailing end of the moved wire are selectively subjected to wire-end processing for each pitch.

6. An apparatus for automatically positioning opposite ends of a wire cut off from a wire source for multi-mode wire-end processings which comprises (a) means for repeatedly paying out a wire from wire source by a predetermined distance, said wire having a leading end;

(b) a wire reversing body provided above said paid-out wire and adapted for 180 degree stepwise rotations in a horizontal plane, said wire reversing body having wire clamping means for clamping a leading end portion of the paid-out wire at a distance spaced from said leading end and having a centerline perpendicularly crossing an axis of paid-out wire, said stepwise rotations of the reversing body and the paying out operations being adapted to take place alternately to place the wire in a hair-pin configuration;

(c) wire gripping means for gripping the paid-out wire at two intermediate portions near to and spaced from said leading end thereof and the crossing point of the centerline and the wire axis; and (d) wire cutting means for cutting the paid-out wire at said crossing point to form a trailing end, of a wire cut-off from the paid-out wire, said clamping means being adapted to release the clamping of the wire after the cutting operation of the wire cutting means.

7. An apparatus according to claim 6, wherein said wire clamping means includes first and second clamp pawl pairs mounted on the bottom surface of the wire reversing body and arranged in a symmetrical relation to each other relative to the center of the reversing body rotation.

8. An apparatus according to claim 7, further including first and second semi-circular plate members carried by the bottom surface of the reversing body on respective sides of said centerline and each having a straight side facing the center of the reversing body rotation, said semi-circular plate members being positioned such that the paid-out wire extends in a tangential relation thereto.

9. An apparatus according to claim 8, wherein the first clamp pawl pair is positioned between the centerline and said first semi-circular plate member, and the second clamp pawl pair is positioned between the centerline and said second semi-circular plate member.

10. An apparatus according to claim 8, wherein each semi-circular plate member has a semi-circular portion provided with a wire guide groove.

11. An apparatus according to claim 6, wherein said wire reversing body is provided with a groove at the centerline portion to receive a cutter means.

12. An apparatus according to claim 7, wherein said wire reversing body has wire guide means for guiding the paid-out wire.

13. An apparatus according to claim 12, wherein said wire guide means includes first and second guide pawl pairs mounted on the bottom surface of the wire reversing body and arranged in a symmetrical relation to each other relative to the center of the reversing body rotation, each guide pawl pair being positioned between a first semi-circular plate member and a second semi-circular plate member.

14. An apparatus according to claim 13, wherein each guide pawl pair include a fixed pawl and a movable pawl, said fixed pawl being positioned inside a tangent against the corresponding semi-circular plate member which tangent extends perpendicular to the reversing body centerline and said movable pawl being positioned outside said tangent in an opposing relation to the fixed pawl and adapted to pivot upward before a reversing body rotation to avoid interference with the wire and pivot downward after said rotation to loosely hold the wire.

15. An apparatus according to claim 6, further including a rocking nozzle assembly to guide the paid-out wire from the wire paying-out means to the wire reversing body and a nozzle clamp provided between the wire paying-out means and the wire reversing body to removably clamp said rocking nozzle assembly.

16. An apparatus according to claim 15, wherein said rocking nozzle assembly comprises a nozzle support block having a hole bored therethrough to guide the wire; a nozzle fixing member attached to the front end of the nozzle support block pivotally in a horizontal plane; a spring attached between the support block and the fixing member; a nozzle piece carried by the nozzle fixing member and adapted to pass therethrough the wire comming out of the hole in the block, said nozzle support having a recess at its rear base portion to receive the wire paying-out means.

17. An apparatus according to claim 15, wherein said nozzle clamp comprises a pair of clamping plates each supported at its intermediate portion for pivotal movement in a plane lateral to the wire axis direction and having an engaging projection bent inwardly from its top, a compression spring mounted on the two clamping plates at their lower portion, and resilient means provided between said clamping plates at their intermediate portions.

18. An apparatus according to claim 15, wherein said wire gripping means includes a pair of sprocket wheels, a chain trained around said sprocket wheels, a plurality of gripper means provided on the chain each two adjacent pairs being spaced from each other by a distance equal to the distance between the leading end and the trailing end of the wire placed in a hair-pin configuration, said sprocket wheels being adapted for stepwise angular rotations each corresponding to said distance after the release of the clamped wire.

19. An apparatus according to claim 18, wherein each gripper means comprises a support plate mounted on the chain; two pairs of grippers pivotally mounted on said support plate each pair including an outer pawl and an inner pawl, each pawl having a projection inwardly extending from its top portion and teeth at its lower portion to mesh with the other pawl; and a tension spring bridged between the outer pawls of both pairs, said pairs being adapted to be opened against the spring force after the wire cutting operation and before the wire paying-out operation.

20. An apparatus according to claim 19, wherein the wire reversing body and the nozzle clamp are adapted for synchronized vertical movement to allow the wire clamping means to place the clamped wire between said outer and inner pawls.

21. An apparatus according to claim 6, wherein said wire paying-out means includes a pair of roller plates provided to hold the wire between peripheral edges thereof and adapted for stepwise angular movement to pay out the wire toward the wire reversing body.

22. An apparatus for automatically positioning opposite ends of each of wires successively cut off from a wire source for multi-mode wire-end processings which comprises (a) means for repeatedly paying out a wire from a wire source by a predetermined distance;

(b) a wire reversing body provided above said paid-out wire and adapted for 180 degree stepwise rotations about a fixed center in a horizontal plane, said wire reversing body having wire clamping means for clamping a leading end portion of the paid-out wire and having a centerline perpendicularly crossing an axis of paid-out wire, said stepwise rotations of the reversing body and the paying out operations being adapted to take place alternately to place the wire in a hair-pin configuration;

(c) wire gripping means for gripping the paid-out wire at two intermediate portions near a leading end thereof and the crossing point of the centerline and the wire axis; and (d) wire cutting means for cutting the paid-out wire at said crossing point to form a trailing end of a wire cut off from the paid-out wire, said clamping means being adapted to release the clamping of the wire after the cutting operation of the wire cutting means and said wire gripping means being adapted for movement in a direction perpendicular to the paid-out wire after the release of the clamped wire in a stepwise manner by the distance between the leading end and the trailing end of the wire placed in said hair-pin configuration.

23. An apparatus according to claim 21, wherein said wire clamping means includes first and second clamp pawl pairs mounted on the bottom surface of the wire reversing body and arranged in a symmetrical relation to each other relative to the center of the reversing body rotation.

24. An apparatus according to claim 23, further including first and second semi-circular plate members carried by the bottom surface of the reversing body on respective sides of said centerline and each having a straight side facing the center of the reversing body rotation, said semi-circular plate members being positioned such that the paid-out wire extends in a tangential relation thereto.

25. An apparatus according to claim 24, wherein the first clamp pawl pair is positioned between the centerline and said first semi-circular plate member, and the second clamp pawl pair is positioned between the centerline and said second semi-circular plate member.

26. An apparatus according to claim 24, wherein each semi-circular plate member has a semi-circular portion provided with a wire guide groove.

27. An apparatus according to claim 24, wherein said wire reversing body is provided with a groove at the centerline portion to receive a cutter means.

28. An apparatus according to claim 27, wherein said wire reversing body has wire guide means for guiding the paid-out wire.

29. An apparatus according to claim 28, wherein said wire guide means includes first and second guide pawl pairs mounted on the bottom surface of the wire reversing body and arranged in a symmetrical relation to each other relative to the center of the reversing body rotation, each guide pawl pair being positioned between the first semi-circular plate member and the second semi-circular plate member.

30. An apparatus according to claim 29, wherein each guide pawl pair includs a fixed pawl and a movable pawl, said fixed pawl being positioned inside a tangent against the corresponding semi-circular plate member which tangent extends perpendicular to the reversing body centerline and said movable pawl being positioned outside said tangent in an opposing relation to the fixed pawl and adapted to pivot upward before a reversing body rotation to avoid interference with the wire and pivot downward after said rotation to loosely hold the wire.

31. An apparatus according to claim 22, further including a rocking nozzle assembly to guide the paid-out wire from the wire paying-out means to the wire reversing body and a nozzle clamp provided between the wire paying-out means and the wire reversing body to removably clamp said rocking nozzle assembly, said nozzle assembly and said wire reversing body being both mounted for vertical movement in synchronism.

32. An apparatus according to claim 31, wherein said rocking nozzle assembly comprises a nozzle support block having a hole bored therethrough to guide the wire; a nozzle fixing member attached to the front end of the nozzle support block pivotally in a horizontal plane; a spring attached between the support block and the fixing member; a nozzle piece carried by the nozzle fixing member and adapted to pass therethrough the wire comming out of the hole in the block, said nozzle support having a recess at its rear base portion to receive the wire paying-out means.

33. An apparatus according to claim 31, wherein said nozzle clamp comprises a pair of clamping plates each supported at its intermediate portion for pivotal movement in a plane lateral to the wire axis direction and having an engaging projection being inwardly from its top, a compression spring mounted on the two clamping plates at their lower portion, and resilient means provided between said clamping plates at their intermediate portions.

34. An apparatus according to claim 22, wherein said wire paying-out means includes a pair of roller plates provided to hold the wire between peripheral edges thereof and adapted for stepwise angular movement to pay out the wire toward the wire reversing body.

35. An apparatus according to claim 31, wherein said wire gripping means includes a pair of sprocket wheels, a chain trained around said sprocket wheels, a plurality of gripper means provided on the chain each two adjacent pairs being spaced from each other by a distance equal to the distance between the leading end and the trailing end of the wire placed in a hair-pin configuration, said sprocket wheels being adapted for stepwise angular rotations each corresponding to said distance after the releasing of the clamped wire.

36. An apparatus according to claim 35, wherein each gripper means comprises a support plate mounted on the chain; two pairs of grippers pivotally mounted on said support plate each pair including an outer pawl and an inner pawl, each pawl having a projection inwardly extending from its top portion and teeth at its lower portion to mesh with the other pawl; and a tension spring bridged between the outer pawls of both pairs, said pairs being adapted to be opened against the spring force after the wire cutting operation and before the wire paying-out operation.

37. An apparatus according to claim 36, wherein the wire reversing body and the nozzle clamp are adapted for synchronized vertical movement to allow the wire clamping means to place the clamped wire between said outer and inner pawls.

38. An apparatus according to claim 35, further including a plurality of wire-end processing devices aligned in a direction perpendicular to the paid-out wire and disposed in association with the respective gripper means at their rest position each device being adapted for selective operation.

* * * * *